US005618062A

United States Patent [19]

Mertens et al.

[11] Patent Number: 5,618,062

[45] Date of Patent: Apr. 8, 1997

[54] NOTE OR NOTE PAD PREPARATION METHOD

[75] Inventors: Timothy A. Mertens, Cottage Grove; Mark S. Vogel, Maplewood, both of Minn.

[73] Assignee: Minnesota Mining and Manufacturing Company, St. Paul, Minn.

[21] Appl. No.: 373,585

[22] Filed: Jan. 17, 1995

Related U.S. Application Data

[63] Continuation-in-part of Ser. No. 973,039, Nov. 9, 1992, Pat. No. 5,382,055.

[51] Int. Cl.[6] ..... B42D 15/00

[52] U.S. Cl. ..... 283/67; 283/117; 412/1; 412/10; 462/67

[58] Field of Search ..... 283/67, 117; 412/1, 412/10; 462/67; 428/40

[56] References Cited

U.S. PATENT DOCUMENTS

| | | |
|---|---|---|
| 798,313 | 8/1905 | Alexander . |
| 1,619,081 | 3/1927 | McLaurin . |
| 2,109,583 | 3/1938 | Bennett . |
| 2,170,147 | 8/1939 | Lane . |
| 2,282,177 | 5/1942 | Dike et al. . |
| 2,411,328 | 11/1946 | MacNab . |
| 3,203,823 | 8/1965 | Grimes . |
| 3,257,228 | 6/1966 | Reed . |
| 3,312,005 | 4/1967 | McElroy . |
| 3,385,743 | 5/1968 | Backberg . |
| 3,464,842 | 9/1969 | Jackstad . |
| 3,554,835 | 1/1971 | Morgan . |
| 3,691,140 | 9/1972 | Silver . |
| 3,857,731 | 12/1974 | Merrill, Jr. et al. . |
| 3,892,427 | 7/1975 | Kraynak et al. . |
| 3,900,642 | 8/1975 | Michel . |
| 3,982,744 | 9/1976 | Kraynak et al. . |
| 4,204,017 | 5/1980 | Hefele . |
| 4,235,459 | 11/1980 | Callahan . |
| 4,416,392 | 11/1983 | Smith . |
| 4,460,634 | 7/1984 | Hasegawa . |
| 4,768,810 | 9/1988 | Mertens . |
| 4,889,234 | 12/1989 | Sorenson . |
| 4,895,746 | 1/1990 | Mertens . |
| 5,021,110 | 6/1991 | Kobayashi . |
| 5,050,909 | 9/1991 | Mertens et al. . |
| 5,114,291 | 5/1992 | Hefty . |
| 5,143,404 | 9/1992 | Flowers, Jr. . |
| 5,154,962 | 10/1992 | Mertens et al. . |
| 5,336,541 | 8/1994 | Kobayashi . |

FOREIGN PATENT DOCUMENTS

| | | |
|---|---|---|
| 0439941A1 | 8/1991 | European Pat. Off. . |
| 0512153A2 | 11/1992 | European Pat. Off. . |
| 2909276 | 9/1980 | Germany . |

*Primary Examiner*—Frances Han

*Attorney, Agent, or Firm*—Gary L. Griswold; Walter N. Kirn; William L. Huebsch

[57] ABSTRACT

A method for making custom printed notes or note pads. One or more sheet assemblies are provided which have first and second sheets and a pattern of pressure-sensitive adhesive on the rear major surface of each of the sheets that contacts and is releasably adhered to the rear major surface of the other sheet only in nonadhesive areas. Indicia is printed on the front major surfaces of the sheets using a conventional copy machine. The sheets can either be cut along predetermined lines to form the custom printed notes, or the sheets of a plurality of such printed sheet assemblies can be separated, stacked to adhere the patterns of pressure-sensitive adhesive on the rear major surfaces of the sheets to the front major surfaces of the sheets with the edges of the sheets in a predetermined orientation with respect to each other, and the stacked sheets can be cut along predetermined lines to form custom printed note pads.

17 Claims, 6 Drawing Sheets

NOTE OR NOTE PAD PREPARATION METHOD

CROSS REFERENCE TO RELATED APPLICATION

This application is a continuation-in-part of U.S. patent application Ser. No. 07/973,039, filed Nov. 9, 1992, now U.S. Pat. No. 5,382,055 issued Jan. 17, 1995.

TECHNICAL FIELD

The present invention relates to methods for printing indicia on paper sheets of the type having a narrow strip of pressure-sensitive adhesive adjacent one edge on its rear side by which the sheets can be adhered to a substrate, making pads of such sheets, and to sheet materials used in such printing methods.

BACKGROUND ART

A well known note pad comprises a stack of paper sheets, each having a narrow strip of low-tack pressure-sensitive adhesive adjacent one edge on its rear side by which the sheets can be temporarily adhered to substrates such as documents or other articles (often for message-bearing purposes), by which strip of adhesive the sheet are adhered together in the pad. In one pad configuration, all of the strips of adhesive are along one side of the note pad, whereas in another pad configuration the adhesive strip on each successive sheet in the pad is along the opposite side of the pad as is illustrated in U.S. Pat. No. 4,416,392. Note pads in both of these configurations are currently being marketed under the trademark "Post-it" by Minnesota Mining and Manufacturing Company, St. Paul, Minn. Some such note pads have printed indicia (e.g., a printed message and/or picture and/or decoration) on each sheet, however, heretofore, such indicia has been printed on sheet material from which the note pads are formed by the manufacturer of the note pads, and printing of indicia on such note pads has only been economically feasible when a large amount of such note pads are produced.

DISCLOSURE OF INVENTION

The present invention provides a method, and a sheet assembly used in that method, by which an individual or a small custom printing company can economically prepare a small amount of notes or note pads having pressure-sensitive adhesive on a rear surface and custom printed indicia (e.g., printed messages and/or decorations and/or pictures and/or indicia that make the notes usable as flags, labels or forms) on the front surfaces of all or some of the sheets using conventional printing means including electrophotography through laser printers, conventional office copiers, lithography, flexography, or the like.

The method for making custom printed notes or note pads according to the present invention utilizes one or more novel sheet assemblies, each of which has first and second sheets and layers of pressure-sensitive adhesive in a predetermined pattern on the rear major surface of each of the sheets that contact and are releasably adhered to the rear surface of the other sheet only in nonadhesive bearing areas. Indicia are printed on the front major surfaces of the sheets using conventional printing means of the type described above. The sheets can then either be separated along predetermined planes normal to and extending across the major surfaces of the sheets to form the custom printed notes, or the sheets of a plurality of such printed sheet assemblies can be separated, stacked to adhere the layers of pressure-sensitive adhesive on the rear surfaces of the sheets to the front surfaces of other sheets in the stack with the layers of adhesive on the sheets in a predetermined orientation with respect to each other; and the stacked sheets can be separated along predetermined planes normal to and extending across the major surfaces of the sheets to form the custom printed note pads.

The adhesive used in the layers of pressure-sensitive adhesive can be a low-tack pressure-sensitive adhesive (e.g., comprising tacky, elastomeric copolymer microspheres) in which case the nonadhesive bearing areas on the rear surfaces of the sheets to which the layers of adhesive are adhered in the sheet assemblies and the front surfaces of the sheets can be free of release coating; or a conventional more aggressive pressure-sensitive adhesive can be used in which case the sheet assembly can include a release coating on those nonadhesive bearing areas to afford separation of the sheets of the sheet assembly after printing, and can further include a release material on the front major surface of one or both of the sheets (e.g., an indicia-receptive polymer) which affords separation of the sheets from the stack.

The sheet assembly can further include orientation indicating means for indicating the orientation of the layers of adhesive on the sheet assembly between the sheets to afford printing in the proper orientation on the sheet, to facilitate separation of the sheets in the sheet assembly, and to facilitate subsequent stacking of the sheets in a desired orientation. The orientation indicating means can be visible, tactile, olfactory, auditory, or tasteable, and can, for examples, be provided by (1) a portion of one sheet adjacent one of its edges extending past the adjacent edge of the other sheet, (2) printed marks on the front surface of one or both of the sheets or printed marks on such a projecting portion, (3) embossed tactile markings on one or both of the sheets, (4) scented portions of one or both of the sheets, (5) coatings on one or both of the sheets that can be tasted, or (6) rough portions on one or both of the sheets that cause a raspy sound when the edge of an object such as a fingernail is rubbed over it. Providing more than one of such orientation means could be useful to accommodate possible users with certain physical handicaps.

The sheets in the sheet assembly can be of any conventional material (e.g., conventional, bond, or clay-coated paper, opaque or translucent polymeric material, or the carbonless paper sold under the trademark "Scotchmark" by Minnesota Mining and Manufacturing Company, St. Paul, Minn. which is paper containing structures such as microencapsulated chemicals that will form an image on the paper when pressure is applied to the paper so that, for example, the capsules are broken by the pressure to release the image forming chemical). The sheets in the sheet assembly can be entirely separate and attached only by the layers of adhesive, or can be made from a larger sheet or web in such a way that they are attached along adjacent edges and have a path of weakness along those attached edges. By "Path of weakness" we mean any weakening of the sheet material along a line that permits the sheets to fold or tear apart along that line while providing sufficient integrity so that the sheets do not separate along that line while they are being imprinted. A suitable path of weakness can be provided by forming spaced perforations through the sheet, crushing the sheet, chemical treatment to reduce the thickness and/or the strength of the sheet, grooves formed by control-depth cuts, or the like.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
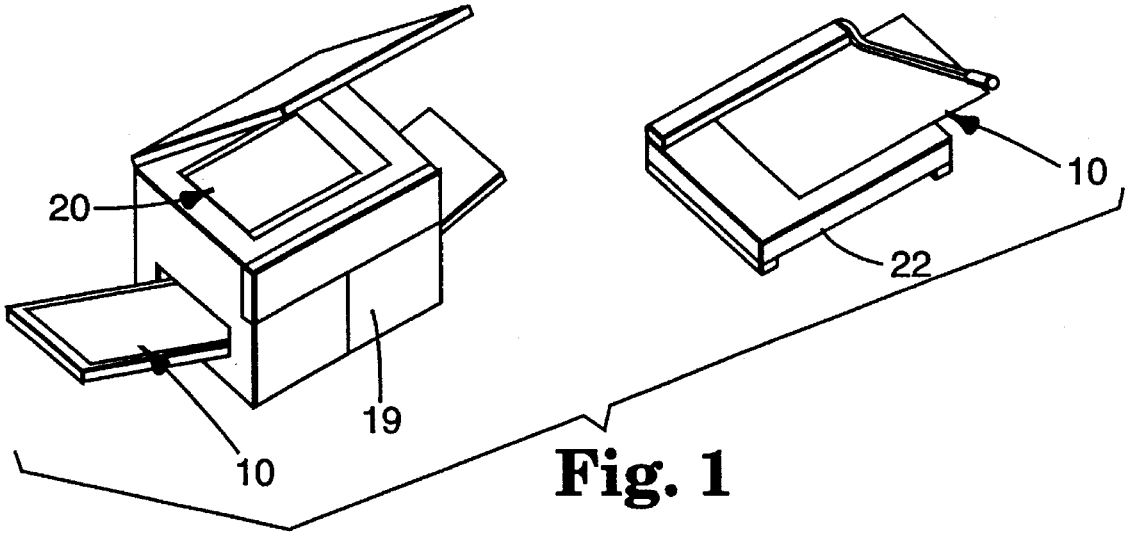
FIG. 1 is a schematic view of a first embodiment of a method according to the present invention for making custom printed notes.
Figure 7:
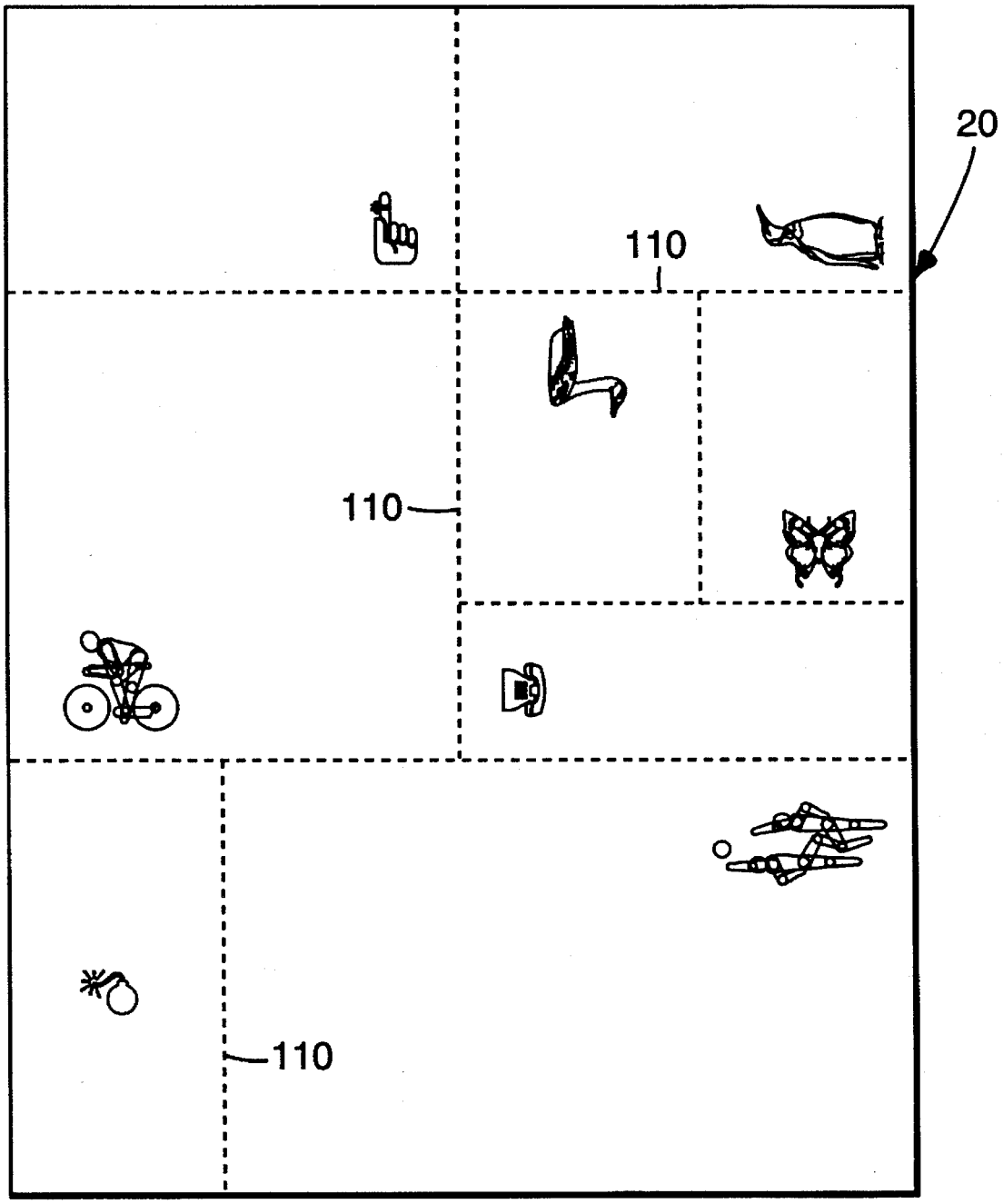
FIG. 7 is a plan view of a pattern sheet that can be used in the methods illustrated in FIGS. 1 and 2.

Referring now to FIG. 1 of the drawing, there is schematically illustrated a first embodiment of a method according to the present invention for making a small amount of custom printed notes. Generally that method comprises the steps of (1) providing a sheet assembly such as the sheet assembly 10 illustrated in FIGS. 3 and 4 which comprises first and second sheets 12 and 13 each having major front and rear surfaces 14 and 15, and spaced layers 16 of pressure-sensitive adhesive in a predetermined pattern on the rear surface 15 of each of the sheets 12 and 13, the layers 16 of pressure-sensitive adhesive in the predetermined pattern on the rear surface 15 of each of the sheets 12 or 13 contacting and releasably adhering to the rear surface 15 of the other sheet 12 or 13 only in nonadhesive bearing areas of that rear surface 15 that are recessed with respect to the layers 16 of pressure-sensitive adhesive (such contact not being illustrated in FIG. 3); (2) printing indicia on at least one of the front surfaces 14 of the sheets 12 and 13 in the sheet assembly 10 using a printing device such as a conventional office copy machine 19 for which there has been prepared an appropriate pattern sheet to be copied, such as the pattern sheet 20 illustrated in FIG. 7; (3) and separating portions of the sheets 12 and 13 along predetermined planes normal to and extending across the major surfaces 14 and 15 of the sheets 12 and 13 to form the custom printed notes (each separated portion having two such notes releasably adhered together by the parts of the layers 16 of adhesive on the notes), which separating could be done by tearing the sheets 12 and 13 along patterns of weakness between the sheet portions (if such patterns of weakness are provided), or by cutting with a conventional scissors, but as illustrated is being done by cutting with a conventional office paper cutter 22. This method allows a person having the sheet assembly 10, a pattern sheet such as the pattern sheet 20 which the person could prepare with custom indicia, and access to a copy machine 19 to easily make a small number of notes having pressure-sensitive adhesive on their back surfaces which are printed with indicia of that persons choosing on their front surfaces.

Figure 2:
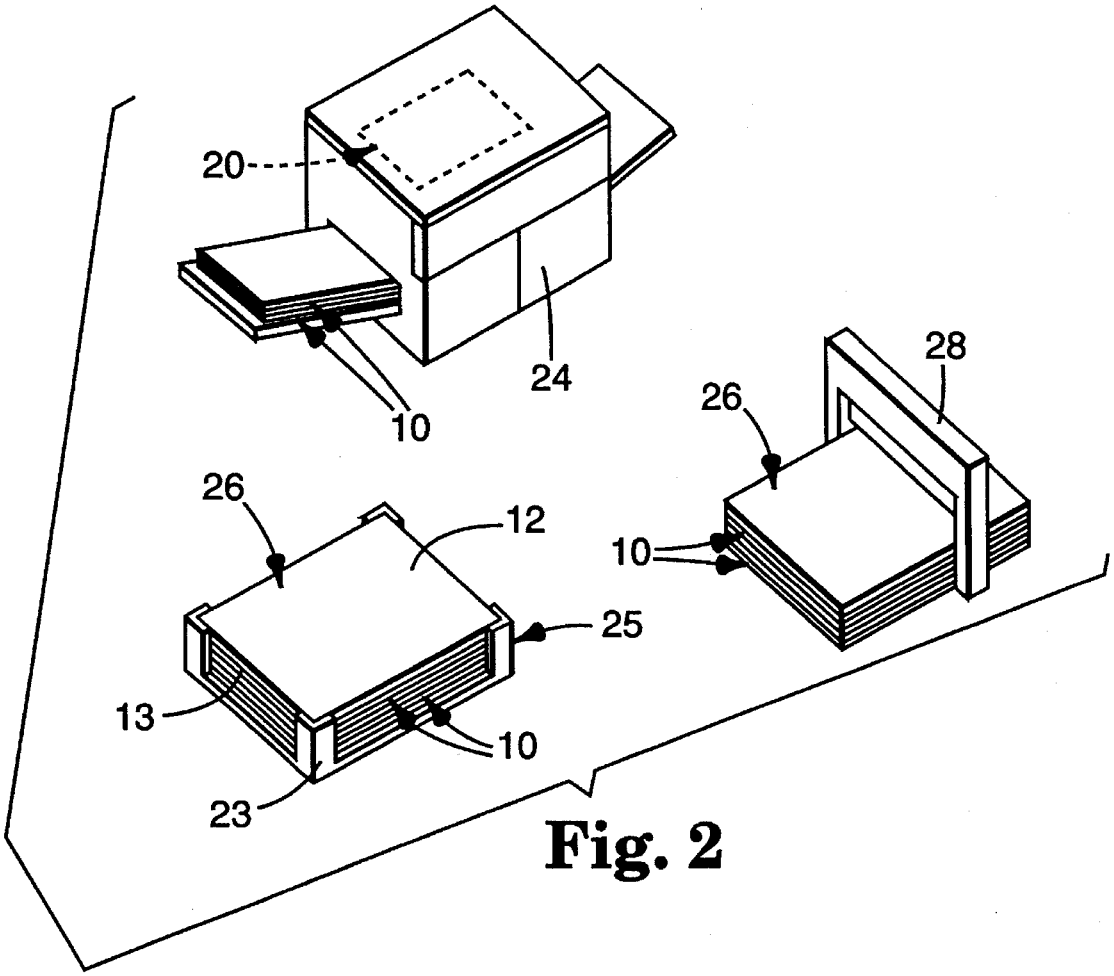
FIG. 2 is a schematic view of a second embodiment of a method according to the present invention for making custom printed note pads.

Referring now to FIG. 2 of the drawing, there is schematically illustrated a second embodiment of a method according to the present invention for making custom printed note pads. Generally that method comprises the steps of (1) providing a plurality of sheet assemblies such as the sheet assembly 10 illustrated in FIGS. 3 and 4, each of which sheet assemblies 10 comprises first and second sheets 12 and 13 each having major front and rear surfaces 14 and 15 and layers 16 of pressure-sensitive adhesive in a predetermined pattern on the rear surface 15 of each of the sheets 12 and 13, the layers 16 of pressure-sensitive adhesive on the fear major surface 15 of each of the sheets 12 or 13 in each of the sheet assemblies 10 contacting and being releasably adhered to the rear surface 15 of the other sheet 12 or 13 only in nonadhesive bearing areas that are recessed with respect to the layers 16 of pressure-sensitive adhesive; (2) printing indicia on at least one and usually both of the front surfaces 14 of the sheets 12 and 13 in at least some and usually all of the sheet assemblies 10 (which indicia could be different on different sheet assemblies 10) using a printing device 24 of the type often found in small printing shops (e.g., a conventional office copy machine for which an appropriate printing pattern is provided by a pattern sheet that is copied such as the pattern sheet 20 illustrated in FIG. 7, electrophotography through laser printers for which an appropriate printing pattern is provided by digital electronic signals from a computer or the like, or, lithography or flexography for which an appropriate printing pattern is provided by printing plates); (3) separating the sheets 12 and 13 in the sheet assemblies 10 after the printing step (not shown); (4) stacking the separated sheets 12 and 13 (e.g., in a stacking frame 25 which aligns adjacent edges of the sheets 12 and 13 adjacent one lower corner 23 of the frame as illustrated) to adhere the layers 16 of pressure-sensitive adhesive on the rear surfaces 15 of the sheets 12 and 13 to the front surfaces 14 of the other sheets 12 and 13 in the stack to form a master stack 26 with the layers 16 of adhesive on the sheets 12 and 13 in a predetermined orientation with respect to each other; and (5) separating the stacked sheets 12 and 13 along predetermined planes normal to and extending across the major surfaces 14 and 15 of the sheets 12 and 13 in the master stack 26 to form the custom printed note pads; which separating could be done by tearing the sheets 12 and 13 along patterns of weakness between the sheet portions (if such patterns of weakness are provided and the note pads are made using very few sheet assemblies 10), or by cutting with a conventional office paper cutter, but, as illustrated, is being done by cutting with a conventional guillotine cutter 28 of a type often found in small printing companies. This method is particularly useful for persons or companies that provide small printing and copying services to the public (e.g., the companies having the trademark "Insty-prints") so that they can form a small amount of custom printed note pads for customers.

Figure 3:
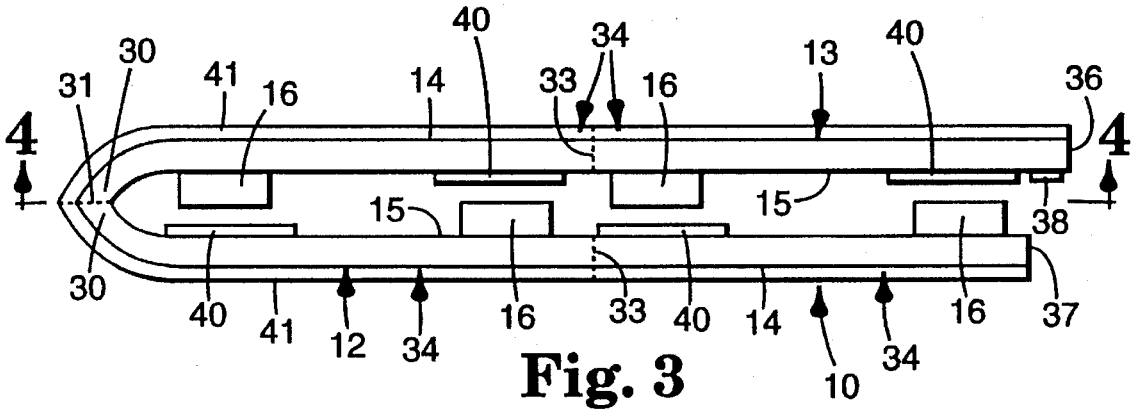
FIG. 3 is an edge view of a sheet assembly according to the present invention that can be used in the methods illustrated in FIGS. 1 and 2.
Figure 4:
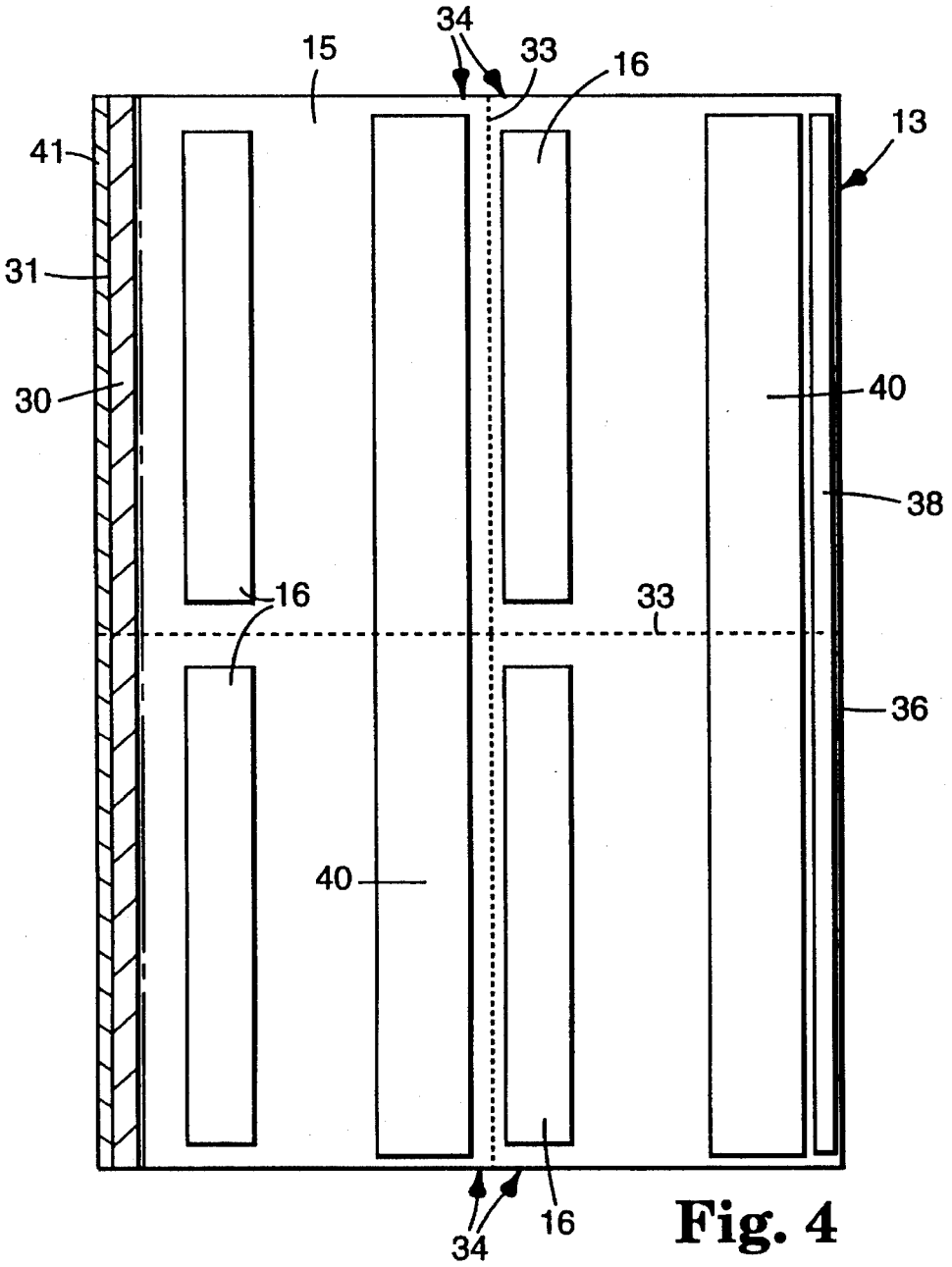
FIG. 4 is a reduced sectional view taken approximately along line 4—4 of FIG. 3.

The sheets 12 and 13 of the sheet assembly 10 illustrated in FIGS. 3 and 4 are half portions of a large sheet or web and joined along adjacent edges 30, with a path of weakness 31 provided by spaced perforations along those joined edges 30 so that the sheets 12 and 13 are folded and can be torn apart along that path of weakness 31, while the strength of attachment between the sheets 12 and 13 across that path of weakness 31 prevents the sheets 12 and 13 from separating along their joined edges 30 while they are being printed. Optionally, as illustrated, the sheets 12 and 14 can also be perforated to have additional paths of weakness 33 along planes normal to and extending across the surfaces 14 and 15 of the sheets 12 and 13 so that the sheets 12 and 13 can be manually separated into segments 34 . The sheets 12 and 13 have adjacent terminal edges 36 and 37 respectively that are opposite the joined edges 30 and between which separation of the sheets 12 and 13 may be initiated. The layers 17 of pressure-sensitive adhesive on the sheets 12 and 13 are in the form of spaced strips of the adhesive that extend transversely of the sheets 12 and 13 parallel to the edges 30, 36 and 37 with each strip being adjacent and extending along an edge of a portion 34 of the sheet that will be formed by separating the sheets 12 and 13 along the paths of weakness 31 and 33.

The sheet assembly 10 is illustrated in FIGS. 3 and 4 with release coatings 40 on the nonadhesive bearing areas of the rear surfaces 15 of the sheets 12 and 13. The release coatings 40 are also in strips, are slightly wider than the strips 16 of adhesive, and extend transversely of the sheets 12 and 13 parallel to the edges 30, 36 and 37 with each strip release coating 40 being adjacent and extending along an edge of a portion 34 of the sheet 12 and 13 that will be formed by separating the sheets 12 and 13 along the paths of weakness 31 and 33, and in a position such that when the rear surfaces 15 of the sheets are placed face to face as illustrated in FIG. 3, the strip layers 16 of adhesive will contact and will be generally centered on the strip release coatings 40. Also, as illustrated, the entire front surface 14 of each of the sheets 12 and 13 is coated with a release coating 41. The illustrated release coatings 40 on the rear surfaces 15 and the release coatings 41 on the front surface 14 of the sheets 12 and 13 are not needed when the layers 16 of adhesive are of low-tack or repositionable adhesive (e.g., the low-tack adhesives based on tacky, elastomeric copolymer microspheres disclosed in U.S. Pat. Nos. 3,961,140 and 3,857,731). The use of the release coatings 40 and 41 allows the use of layers 16 of pressure-sensitive adhesive that are more aggressive or permanent than repositionable adhesive. Suitable release coatings 40 and 41 are materials and treatments which provide a controlled separation force from the layers 16 of adhesive. The release coating 41 should comprise an indicia-receptive material or polymer to facilitate printing on the front surfaces 14 of the sheets 12 and 13. Typical release coatings 40 and 41 include silicones, acrylates, chrome complexes, and fluorochemicals. Even with layers 16 of aggressive pressure-sensitive adhesive the release coatings 40 and 41 might not be required if the sheets 12 and 13 are of a material, or are impregnated with a material, from which the layer 16 of adhesive readily releases.

The sheets 12 and 13 are generally of flat, flexible material including, but not limited to, plain or bond paper, clay coated paper, films, foils, nonwoven materials, opaque or transparent polymeric materials and carbonless paper, and could have double layers so that they form pouches or envelopes.

Figure 5:
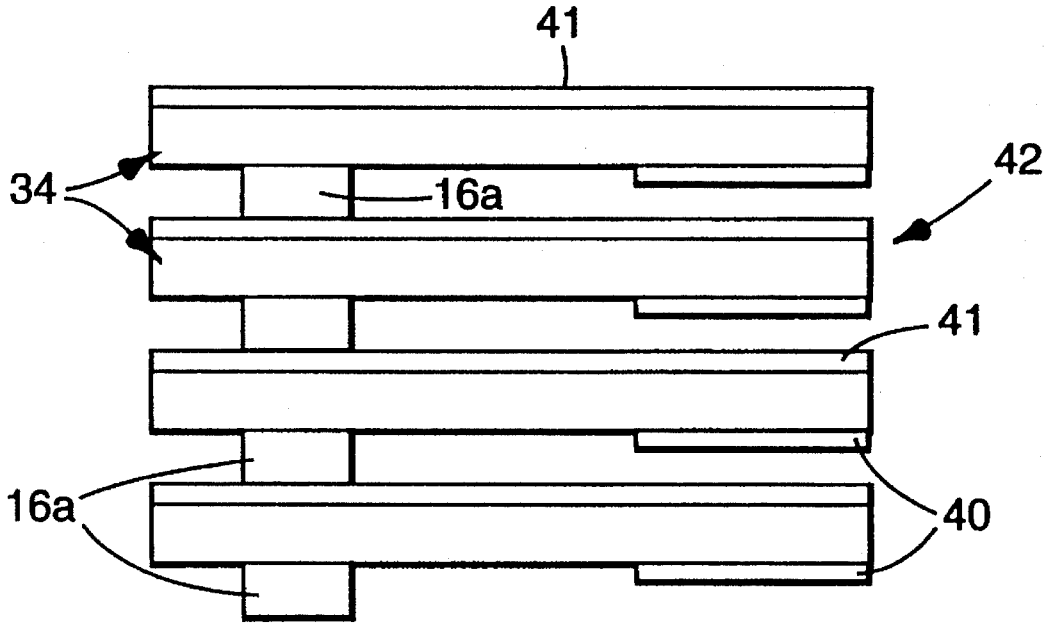
FIGS. 5 and 6 are edge views of optional forms of note pads made by the method of FIG. 2.
Figure 6:
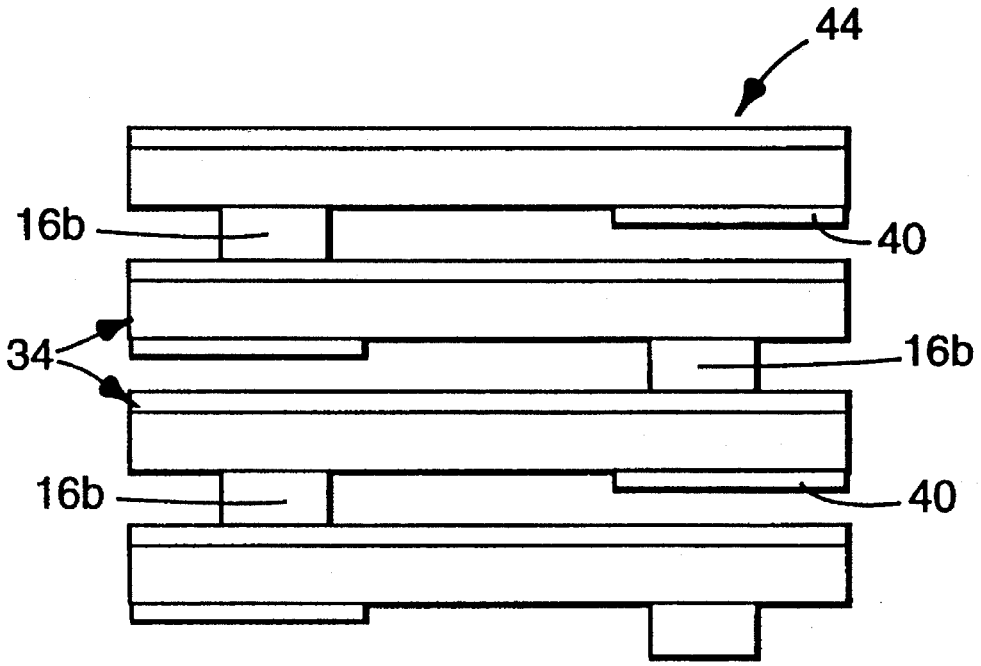

The sheets 12 and 13 can be stacked as described above to form a master stack 26 with the layers 16 of adhesive on the sheets 12 and 13 in a predetermined orientation directly above each other which can result in note pads such as a note pad 42 illustrated in FIG. 5 which has a portion **16*a* of one of the layers 16 of adhesive along a corresponding edge of each portion 34 of one of the sheets 12 or 13 in the pad 42; or the sheets 12 and 13 can be stacked to form a master stack 26 with the layers 16 of adhesive on the sheets 12 and 13 in a predetermined orientation spaced from above each other which can result in note pads such as a note pad 44 illustrated in FIG. 6 in which each successive portion 34 of one of the sheets 12 or 13 in the pad has a portion 16*b* of one of the layers 16 of adhesive along an opposite edge of the pad 44**.

The sheet assembly 10 also includes indicating means for indicating the orientation of the layers 16 of pressure-sensitive adhesive between the sheets 12 and 13 of the sheet assembly 10. As illustrated that indicating means for indicating the orientation of the layers 16 of pressure-sensitive adhesive is provided in two ways, (1) by a portion of the second sheet 13 adjacent its edge 36 extending past the adjacent edge 37 of the first sheet 12, and (2) by providing a mark or indicia 38 on the projecting portion of the second sheet 13. With appropriate instructions (which may be provided by the indicia 38) a user can be made aware of the orientation of the layers 16 of adhesive with respect to the edges of the sheets 12 and 13 in the sheet assembly 10 so that he can print the indicia on the front surfaces 14 of the sheets 12 and 13 in the proper orientation with respect to those layers 16 of adhesive. As an alternative to the indicating means illustrated, either a projecting portion of one of the sheets 12 or 13 or a mark or indicia such as the indicia 38 illustrated may be used alone, or the sheet assembly 10 could be made without any such indicating means.

Figure 8:
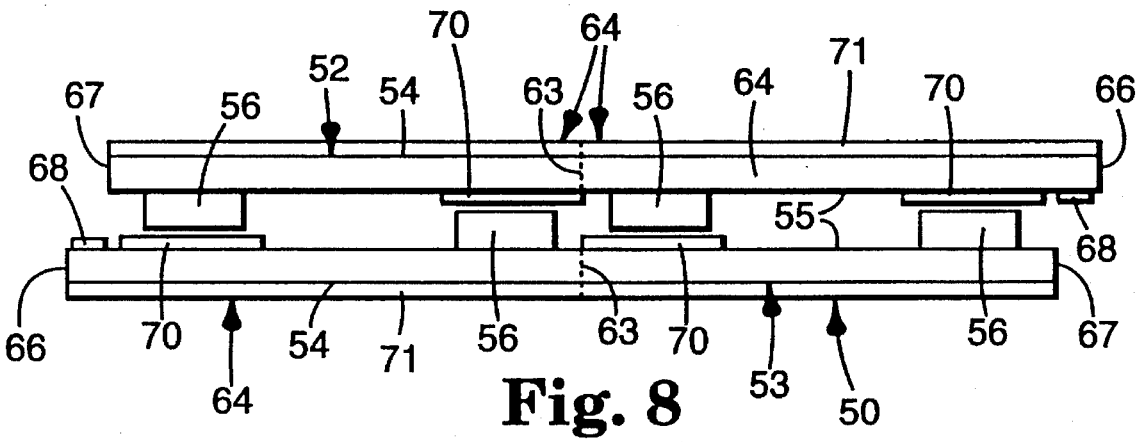
FIGS. 8 and 9 are edge views of second and third alternate embodiments of sheet assemblies according to the present invention that can be used in the methods illustrated in FIGS. 1 and 2.

FIG. 8 illustrates a second embodiment of a sheet assembly 50 according to the present invention that could be used in the methods illustrated in FIGS. 1 and 2. Like the sheet assembly 10 illustrated in FIGS. 3 and 4, the sheet assembly 50 illustrated in FIG. 8 comprises first and second sheets 52 and 53 each having major front and rear surfaces 54 and 55, and spaced layers 56 of pressure-sensitive adhesive in the same predetermined pattern on the rear surface 55 of each of the sheets 52 and 53, the layers 56 of pressure-sensitive adhesive in the predetermined pattern on the rear surface 55 of each of the sheets 52 or 53 contacting and releasably adhering to the rear surface 55 of the other sheet 52 or 53 only in nonadhesive bearing areas 58 of that rear surface 55 that are recessed with respect to the layers 56 of pressure-sensitive adhesive (such contact not being illustrated in FIG. 8). Unlike the sheets 12 and 13 of the sheet assembly 10 illustrated in FIGS. 3 and 4, the sheets 52 and 53 are totally separate rather than being joined along one edge, and each of the sheets has corresponding opposite edges 66 and 67. Optionally, as illustrated and like the sheets 12 and 13, the sheets 52 and 53 can also be perforated to have paths of weakness 63 along planes normal to and extending across the surfaces 54 and 55 of the sheets 52 and 53 so that the sheets 52 and 53 can be manually separated into segments 64; and the sheet assembly 50 can have release coatings 70 on the nonadhesive bearing areas of the rear surfaces 55 of the sheets 52 and 53 (which coatings 70 are not needed if the adhesive is low tack) which coatings 70 are also in strips, are slightly wider than the strips 56 of adhesive, and extend transversely of the sheets 52 and 53 parallel to the edges 66 and 67 with each strip release coating 70 being adjacent and extending along an edge of a portion 64 of the sheet 52 and 53 that will be formed by separating the sheets 52 and 53, and in a position such that when the rear surfaces 55 of the sheets are placed face to face as illustrated, the strip layers 56 of adhesive will contact the strip release coatings 70 in a generally central position; and the entire front surface 54 of each of the sheets 52 and 53 can be coated with a release coating 71 (which coating 71 is also not needed if the adhesive is low tack). Like the layers 17 of pressure-sensitive adhesive on the sheets 12 and 13, the layers 57 of pressure-sensitive adhesive on the sheets 52 and 53 are in the form of spaced strips of the adhesive that extend transversely of the sheets parallel to their opposite edges 66 and 67 with each strip being adjacent and extending along an edge of a portion 64 of the sheet that will be formed by separating the sheets 52 and 53 along the paths of weakness 63.

The sheet assembly 50 also includes indicating means for indicating the orientation of the layers 56 of pressure-sensitive adhesive between the sheets 52 and 53 of the sheet assembly 50. As illustrated that means for indicating the orientation of the layers 56 of pressure-sensitive adhesive is provided in two ways, (1) by end portions of both sheets 52 and 53 adjacent their edges 66 extending past the adjacent edge 67 of the other sheet 52 or 53, and (2) by providing a mark (e.g., an arrow) or indicia (e.g., written instructions) 68 on those projecting portions of the sheets 52 and 53. Alternatively, one of the sheets 12 or 13 could be notched and indicia may be printed on the other sheet in the notch, a projecting portion of one of the sheets 52 or 53 may be used without indicia, or a mark or indicia may be used alone on the front surface 14 and at the edge of either of the sheets 12 or 13, or the sheet assembly may be made without such indicating means.

Figure 9:
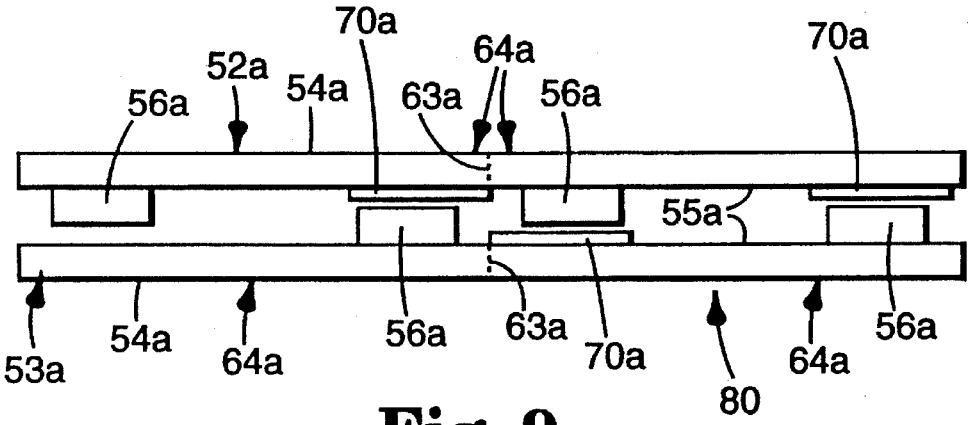

FIG. 9 illustrates a third embodiment of a sheet assembly 80 according to the present invention that could be used in the methods illustrated in FIGS. 1 and 2, which sheet assembly 80 is essentially the same as the sheet assembly 50 illustrated in FIG. 8 with similar parts being similarly numbered except for the addition of the suffix "a" except that no indicating means is provided, no layers of release coating are provided on the front surfaces of the sheets and no layer of release coating is provided adjacent one of the layers 56*a* of adhesive adjacent one end of the sheet assembly 80 on the sheet 53*a*. Thus, one of the sheets 52*a* of the sheet assembly 80 has a release coating on all of its nonadhesive bearing areas that will be contacted by layers 56*a* of adhesive and the other sheet 53*a* of the sheet assembly 80 has a release coating on only a portion of the nonadhesive bearing areas that will be contacted by layers 56*a* of adhesive so that the adhesion between at least one layer 56*a* of adhesive and the nonadhesive bearing area it contacts that has no release coating will adhere the sheets 52*a* and 53*a* together with sufficient firmness to facilitate printing of the front surfaces 54*a* of the sheets 52*a* and 53*a* without separation of the sheets 52*a* and 53*a*.

Figure 10:
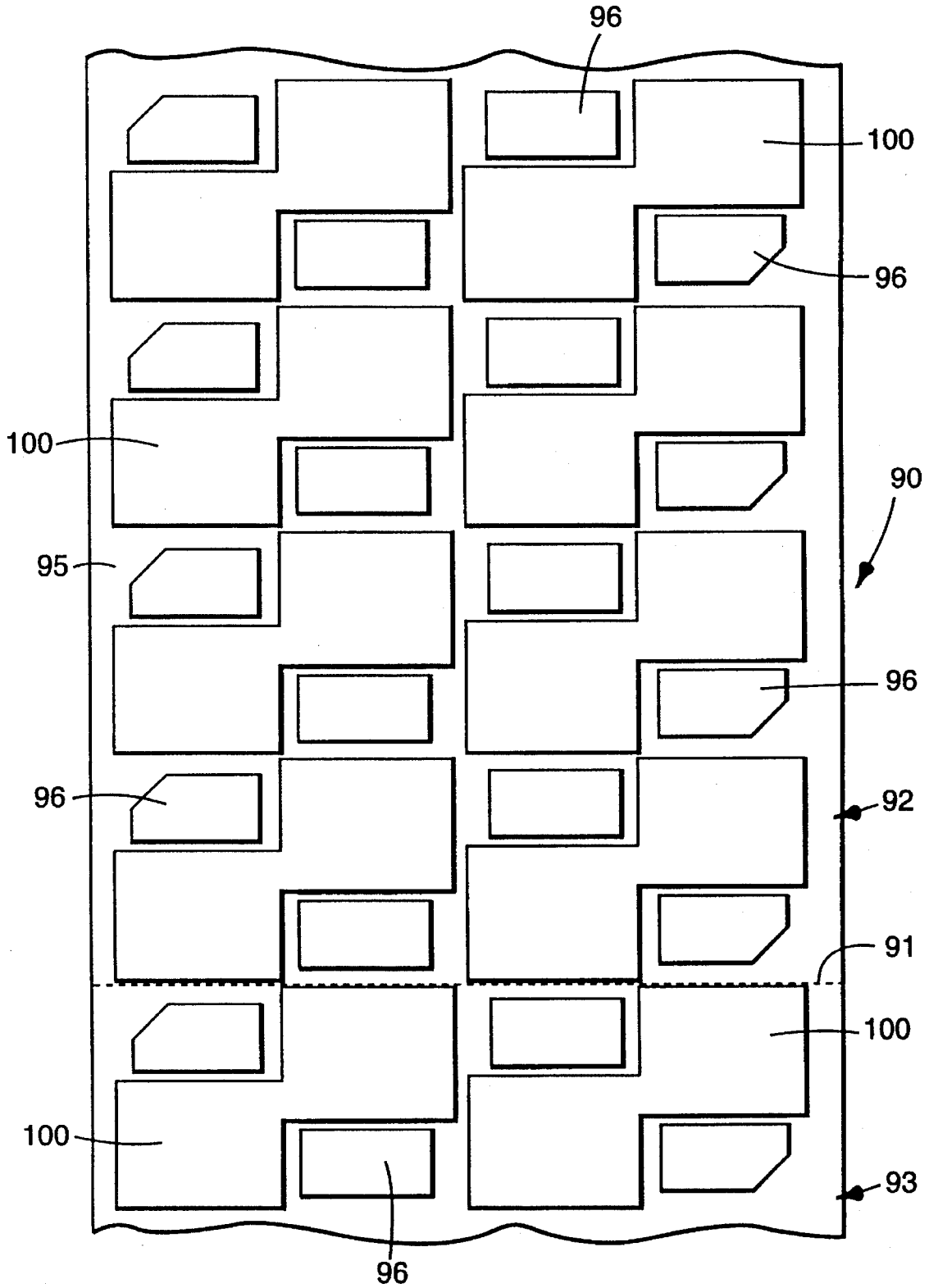
FIG. 10 is a fragmentary view illustrating an alternative pattern for layers of adhesive that can be used on a sheet assembly used in the methods illustrated in FIGS. 1 and 2.

FIG. 10 illustrates an unfolded sheet assembly 90 comprising two sheets 92 and 93 separated by perforations forming a path of weakness 91 with an alternative pattern to that illustrated in FIGS. 2, 3, 8 and 9 for spaced layers 96 of pressure-sensitive adhesive in a predetermined pattern on rear surfaces 95 of the two sheets 92 and 93. That predetermined pattern is a rectangular pattern with every other rectangle in each direction being the same (i.e., either bearing a layer 96 of pressure-sensitive adhesive or being free of pressure-sensitive adhesive). The layers 96 of pressure-sensitive adhesive in the predetermined pattern on the rear surface 95 of each of the sheets 92 or 93 are adapted to contact and releasably adhere to the rear surface 95 of the other sheet 92 or 93 only in nonadhesive bearing areas of that rear surface 95 that are recessed with respect to the layers 96 of pressure-sensitive adhesive. Also, as illustrated, the sheet assembly 90 has release coatings 100 on the nonadhesive bearing areas of the rear surfaces 95 of the sheets 92 and 93 which are slightly larger in area than the layers 96 of adhesive, and are disposed in a position such that when the rear surfaces 95 of the sheets 92 and 93 are placed face to face while joined along the path of weakness 91, the layers 96 of adhesive will contact and will be generally centered on the release coatings 100. The entire front surface of each of the sheets 92 and 93 may optionally also be coated with a release coating. The illustrated release coatings 100 on the rear surfaces 95 and the release coatings on the front surfaces 94 of the sheets 92 and 93 may not be needed when the layers 96 of adhesive are of low-tack or repositionable adhesive, but may be useful if the layers 96 of pressure-sensitive adhesive that are more aggressive or permanent than repositionable adhesive. Pads can be made from the sheet assembly 90 using the method described above with respect to FIGS. 1 and 2 that have one or more of the layers 96 of adhesive adhering together the portions of the sheets 92 and 93 forming the pads. Even when two, four or more of the layers 96 of adhesive adhere together the portions of the sheets 92 and 93 forming the pads, corners of the sheet portions in the pads will be un-adhered to facilitate separation of those corners from the rest of the pad to initiate pealing away of a portion of one of the sheets 92 or 93 in the pad. Such separation may also be facilitated at corners of the pad adjacent the layers of adhesive by removing corners from the otherwise rectangular layers 96 of pressure-sensitive adhesive along the sides of the sheets 92 and 93.

EXAMPLE 1

An example of the sheet assembly 10 illustrated in FIGS. 3 and 4 was made and tested. Release material for the coatings 40 and 41 was prepared in accordance with the teachings in U.S. Pat. No. 5,154,962 (Mertens, et. al.), Example 41, (the content whereof is incorporated herein by reference) except the material was made in 55 gallon reactors, and the chemical composition was 47.0 percent methyl acrylate, 36.5 percent n-vinyl pyrrolidone, 5.3 percent acrylic acid, and 31.3 percent silicone macromer. The dispersion contained 12 percent tetrapolymer, 12 percent butyl carbitol, and 76 percent water. Pressure-sensitive adhesive for the coatings 16 was prepared from the teachings in European Patent Application No. 90313801.4 (Bohnel), Example 21, (the content whereof is incorporated herein by reference) with the material composition being 66.2 percent microsphere dispersion, 27.4 percent Hycar 26222, 19.3 percent deionized water, 0.7 percent ASE 95, 0.1 percent stepanol. A primer for improving the anchorage of the layers 16 of to the sheets 12 and 13 web was prepared by dissolving 4.5 parts by weight "Elvanol"(™) 71–30 (commercially available from the DuPont Company) into 95.5 parts by weight water. To 69.0 parts by weight of the mixture, was added 35.0 parts by weight 3 micron CaCO3. The composition was well mixed. The primer was flexographically applied to both sides of the paper sheets 12 and 13, and was dried. The release material and pressure-sensitive adhesive were flexographically printed on and dried on one face of a web of bond paper, to provide the pattern illustrated in FIGS. 3 and 4 with the release coatings 40 in rectangles 20.6 cm wide and 3.8 cm long, and the layers 16 of pressure-sensitive adhesive in rectangles 7.1 cm wide and 3.6 cm long with adjacent aligned layers 16 being separated by 1.0 cm. The web was perforated to provide the paths of weakness illustrated in FIGS. 3 and 4. In subsequent processing, the release coating 41 was coated on the front surfaces 14 of the sheets 12 and 13 using rotogravure processing and was dried. The web was then folded and separated to form sheet assemblies 10 that were 21.6 cm wide by 27.9 cm long, and were perforated in the width every 7.0 cm. Sheet assemblies 10 were then printed in a Hewlett Packard "LaserJet III" on both sides by feeding the assembly through the machine twice. Both graphics and printed indicia were printed on the sheet assemblies 10. Subsequently, the sheets 12 and 13 of the printed sheet assemblies were peeled apart, and torn apart along the perforations or path of weakness 31 at their ends 30. The separated sheets 12 and 13 were then manually stacked and separated along the perforations or paths of weakness 33 to provide note pads of the type 42 illustrated in FIG. 5. Similar printed and separated sheets 12 and 13 were manually stacked and separated along the perforations or paths of weakness 33 to provide note pads of the type 44 illustrated in FIG. 6.

EXAMPLE 2

Examples of the sheet assemblies 10 were made using the same bond paper, adhesive, primer, and coating methods and other method described in Example 1, except that the release material used in the coatings 40 on the rear surface 15 was the heat curable silicone, 96 percent "Syl-Off"(™) 7676 and 4 percent "Syl-Off"(™) 7677 (commercially available from Dow Corning Corp.), and no release coating was applied to the front surface 14 of the sheets 12 and 13. These sheet assemblies were printed and converted into pads in the same manner described in Example 1 and were found to perform well.

EXAMPLE 3

Example sheet assemblies generally of the type 10 illustrated in FIGS. 3 and 4 were made using sheets 12 and 13 of carbonless paper of the type commercially available from 3M under the trademark "Scotchmark". A release material for the coating 40 was prepared by dissolving 12 g "Syl-Off" ™ 7610 and 0.5 g "Syl-Off" ™ 7611 (both commercially available from Dow Corning (Corp.) into 88 g toluene. An adhesive material for the layers 16 of adhesive was prepared from a suspension in organic solvent of 10 parts of the copolymer of 95% iso-octyl acrylate and 5% acrylic acid and 90 parts of tacky elastomeric copolymer microspheres ranging in diameter from about 10 to 150 micrometers. The adhesive was coated from about 13 percent solids content using a slot with an 0.10 mm orifice to a silicone treated web and dried to form a transfer tape. A swab was prepared to manually apply the release coating in various configurations. The swab used a 3 cm wide paper towel attached to a tongue depressor. Laser pre-perforated carbonless paper was preprinted and cut to form sheets 21.6 cm wide and 29.2 cm long, each with a perforation 13 mm from the top of the sheet. Two sets of carbonless forms with a top sheet and a second copy sheet were coated with silicone along the terminal edge opposite the perforation. The silicone composition was cured in heat. To both top sheets was applied a 10 mm long strip of transfer tape 20.3 cm wide, along the terminal edge next to the perforation. The silicone web was removed to expose the adhesive. The sheets 12 and 13 were aligned and laminated such that the layer of adhesive 16 on one sheet contacted the release coating of the adjacent sheet. To the bottom sheets was applied a 10 mm long strip of transfer tape 14 cm wide, along the terminal edge next to the perforation. The silicone web was removed to expose the adhesive. The sheets 12 and 13 were aligned and laminated such that the layer of adhesive 16 on one sheet contacted the release coating of the adjacent sheet. The assemblies were found to be stable when handled. Both assemblies were printed in a Hewlett Packard "LaserJet III" laser printer. The assemblies were separated and stacked into two form sets, each with top and bottom sheets. The sets were found to dispense in the manner described by U.S. Pat. No. 5,050,909.

EXAMPLE 4

An example of the sheet assembly illustrated in FIG. 9 was prepared. Two sheets 52*a* and 53*a* of bond paper were prepared with dimensions 21.6 cm wide and 14.0 cm long. A transverse perforation 63*a* was made at 7.0 cm of length for each sheet 52*a* and 53*a*. A 20 mm wide swab was prepared as in Example 3. A transfer tape was prepared using the adhesive composition described in Example 3, only it was coated using a 0.05 mm orifice. The adhesive was dried. The silicone from Example 3 was applied to form the coatings 70*a* in strips across the width of the paper sheets 52*a* and 53*a*. Two strips 70*a* were applied to the first sheet 52*a*, one along a terminal edge, and the second along the perforation 63*a* on its side opposite that terminal edge. One strip 70*a* was applied to the second sheet along the perforation 63*a*. Two strips of 12 mm long transfer tape were applied across the width of each sheet 52*a* and 53*a* to form the layers 56*a* of adhesive disposed as illustrated in FIG. 9. After the tape was laminated to the sheets 52*a* and 53*a*, the release liner was removed to uncover the adhesive. The rear surfaces 55*a* of the sheets 52*a* and 53*a* were adhered together resulting in three layers 56*a* of adhesive contacting release coatings 70*a* of silicone and one layer 56*a* of adhesive strip contacting the uncoated inner surface 55*a* of the sheet 53*a* as is illustrated in FIG. 9. The sheet assembly 80 was found to be stable, and was printed in a Hewlett Packard "LaserJet III" laser printer.

EXAMPLE 5

Ten example sheet assemblies 10 were prepared as described above in Example 1. Artwork on a pattern sheet was prepared using computer software and a laser printer. The artwork consisted of eight (8) images positioned on the pattern sheet so that it would generally align with the portions 34 of the sheets 12 and 13 defined by the perforations or paths of weakness 33. Two copies of the pattern sheet were printed by the laser printer and used for printing both front surfaces 14 of the sheet assemblies 10 on a Lanier 6272 copier used in duplex mode The printed sheets 12 and 13 of the sheet assemblies 10 were sequentially pealed apart and separated at the path of weakness 31. The sheets 12 and 13 were stacked into a master stack 26 as illustrated in FIG. 2 using a box lid elevated at one corner as the stacking frame 25 so that sheets were aligned on the stack 26 against the corner of the box lid opposite its elevated corner. The master stack 26 was cut into 16 individual note stacks 10.8 cm wide and 7.0 cm tall using a guillotine cutter 28.

EXAMPLE 6

Examples of the sheet assembly 90 illustrated in FIG. 10 were made using the materials and processes described in Example 1. The sheet assemblies 90 made were 21.6 cm wide and 27.9 cm long. The layers 96 of adhesive were each about 4.1 cm wide and 2.5 cm long. The sheet assemblies 90 were printed using the artwork illustrated in FIG. 7 using a Lanier 6272 copier in duplex mode. The sheets 92 and 93 of the printed sheet assemblies 90 were separated and stacked as illustrated in FIG. 2 with the layers 96 of adhesive on the sheets 92 and 93 adjacent the front surfaces 94 of the adjacent sheet by aligning corners of the separated sheets 92 and 93 in the corner of a tray, which tray was elevated on its side diagonally opposite the corner against which the sheets were aligned to provide a gravitational aid in alignment. The master stack of the sheets 92 and 93 thus formed was then cut along cut lines 110 illustrated in FIG. 7 to form pads of different sizes. The portions of the sheets 92 and 93 in each pad had at least one layer 96 of adhesive to adhere those portions together, and the sheet portions in the larger pads which had two or more diagonally disposed layers 96 of adhesive which adhered them together.

EXAMPLE 7

Examples were made of sheet assemblies specifically designed to be fed through printers, such as digital printers and office copiers, that print sheets on both surfaces in what is often called "duplex" mode. Such printers, for example, print on both surfaces by printing a series of sheets on one surface, accumulating the sheets in a storage tray, and then automatically feeding the sheets from the storage tray and printing them on their second surfaces. One such printer is a xerographic printer manufactured by Xerox Corporation, Rochester, N.Y., and marketed under the name "Docu-Tech". That printer first feeds sheets sequentially from the top of a stack to its printing mechanism, prints those sheets on one side, accumulates the printed sheets in a storage tray, and then prints the sheets on their second surfaces by feeding them into the printing mechanism from the bottom of the stack in the storage tray. Another such printer is a copier manufactured by Lanier Worldwide, Inc., Atlanta, Ga., that uses mechanical sheet feeders to feed the topmost sheet from both the feed tray and from the tray in which the sheets are accumulated after they are printed on one side. Thus sheet assemblies printed in the types of printers described above are acted upon by two sheet feeders that are each designed to separate a single piece of paper from a stack of sheets. Accordingly, sheet assemblies of the type described in this application must be able to resist separation between their first and second sheets as they are fed by the sheet feeders in such printers, for if even partial separation occurs, the sheet can become misaligned to expose adhesive which can effect proper printing, or may wrinkle or buckle which can cause it to jam in the printer.

A sheet assembly particularly adapted to be printed on both sides in the types of printers described above was made which had the structure illustrated in FIG. 3 except that four instead of two layers 16 of pressure sensitive adhesive were placed in spaced relationship on each sheet 12 and 13. The sheets 12 and 13 were each 20 pound bond paper and were each about eight and one half by 11 inches in size, with the sheet 13 being sightly longer so that it projected about 0.1 inch past the edge 37. The layers 16 of pressure sensitive adhesive were microsphere structured copolymer adhesive described in U.S. Pat. No. 3,691,140 (Silver) dispersed in n-heptane at 8 percent solids. The layers of release coating 40 were crosslinked Syl-Off 7676 coated at 20 percent solids in 2-butanone. The paper was first primed with a vinyl solution containing zinc oxide. The release coating 41 was a polymer described in U.S. Ser. No. 08/040876 Example 1, except the composition was KF2001/MA/MAA/MMA 25/50/20/5 dispersed in 2-butanone to 1.5 percent solids. The adhesive was coated to provide an adhesion comparable to Post-it® notes (i.e., approximated 0.6 N/dm adhesion to glass), in 0.75-inch (1.9 cm) wide stripes 16 extending the full width of the sheets 12 and 13. The opposing strip of release coating 40 was coated with a gravure cylinder to provide 1.25-inch (3.2 cm.) wide stripes extending the full width of the sheets 12 and 13. The materials were coated on a wide web and subsequently converted and folded to form the sheet assemblies 10. These sheet assemblies 10 were printed on each sheet 12 and 13 by sending the sheet assembly 10 twice through a Hewlett-Packard LaserJet III xerographic printer. A one-inch (2.54 cm) wide strip was cut from the printed sheet assembly 10 in a direction perpendicular to the fold between the sheets 12 and 13. The portion of the strip formed from one of the sheets 12 or 13 was adhesively bonded to a lower plate attached to a constant-rate-extension device, and the portion of the strip formed from the other sheet 12 or 13 was attached to the load cell of that device. The strip portions were separated at 12 inches per minute (30.5 cm/min.) and the force to separate the strip portions was recorded. The average force required to separate the part of each layer of pressure sensitive adhesive 16 on each strip portion from the opposing strip portion was reported as the "separation force", which for this Example was less than 1 gram per inch.

A second test was performed to determine the sheet stability in a duplex printing operation. One hundred (100) sheet assemblies 10 made as described above were placed in the sheet feeder bin of a Lanier 6540 copier commercially available from Lanier Worldwide, Inc., Atlanta, Ga. The copier was placed in duplex mode, set to print 100 consecutive copies on both sides, and started. The number of times the machine stopped or "jammed" because of the sheet assemblies 10 being printed by the machine was reported as the "jam rate", which of the sheet assemblies 10 described above in this Example was 12 sheets per 100.

The strips of release material 40 on a plurality of the sheet assemblies made as described above were then scraped away using razor blades. When the tests described above were repeated, the separation force of the parts of the stripes of adhesive 16 was about in the range of 20 to 30 grams per inch, and the jam rate of the sheet assemblies 10 was reduced to zero (0) sheets per 100.

EXAMPLE 8

Sheet assemblies 10 were made as in Example 7 with a change in the material and coating weight of the release coating 40. The Syl-Off silicone was replaced with a 20 percent solids solution of the release coating described in U.S. Ser. No. 08/040876 Example 1, except the composition was KF2001/MA/MAA/MMA 25/50/20/5 dispersed in 2-butanone. All the strips of release coating 40 were coated at the same coating weight except for the strip of release coating 40 furthest from the fold between the sheets 12 and 13 which was given a heavier coating of the release material. The materials were all coated on a wide web and subsequently converted into the sheet assemblies 10. These sheet assemblies were tested as described in Example 7 resulting in a separation force for the part of the stripe of adhesive 16 furthest from fold being about 7 grams per inch, the separation force of all other parts of the stripes of adhesive 16 being about 72 grams per inch, and the jam rate of the sheet assemblies 10 being zero (0) sheets per 100.

Subsequently, the sheets 12 and 13 of the sheet assemblies 10 were separated and stacked into pads. The process of separating the sheets 12 and 13 induced a curl in the sheets 12 and 13 which was evident in the finished pad, thereby negatively affecting its appearance.

EXAMPLE 9

Sheet assemblies 10 were made as described in Example 8 except the stripes of release material 40 were applied at a heavier coating weight, with the strip of release material furthest from the fold having even a heavier coating weight than the rest. Those sheet assemblies were tested as described in Example 7 resulting in a resulting in a separation force for the part of the stripe of adhesive 16 furthest from fold being 4 grams per inch, the separation force of all other parts of the stripes of adhesive 16 being 9 grams per inch, and the jam rate of the sheet assemblies 10 being zero (0) sheets per 100.

Subsequently, the sheets 12 and 13 of the sheet assemblies 10 were separated and stacked into pads. The process of separating the sheets 12 and 13 did not induce a significant curl in the sheets 12 and 13 so that the finished pads had an acceptable appearance.

From Examples 7, 8 and 9 described above it was determined that in sheet assemblies 10 of the type described in those examples intended to be used in printers that print on both of the sheets 12 and 13 the separation force for the stripes of adhesive 16 (except for the stripe of adhesive 16 furthest from the fold) should be over 5 grams per inch, and should preferably be about in the range of from 9 to 30 grams per inch to produce an acceptable jam rate for such printers.

Also, it is advantageous to provide a very low bond force between the sheets along at least one edge of the sheet assembly to facilitate separation of the sheets 12 and 13 after printing, either manually or by a separating mechanism. In the sheet assemblies described above in Examples 7, 8 and 9 it was found desirable to have a separation force of less than 10 grams per inch for the stripe of adhesive 16 furthest from the fold.

The present invention has now been described with reference to several embodiments thereof. It will be apparent to those skilled in the art that many changes can be made in the embodiments described without departing from the scope of the present invention. Thus the scope of the present invention should not be limited to the methods and structures described in this application, but only by the methods and structures described by the language of the claims and the equivalents of those methods and structures.

We claim:

1. A method for making custom printed notes, said method comprising the steps of:

providing a sheet assembly comprising first and second sheets each having major front and rear surfaces, and layers of pressure-sensitive adhesive in a predetermined pattern on the rear surface of each of the sheets, the layers of pressure-sensitive adhesive on the rear surface of each of the sheets contacting and being releasably adhered to the rear surface of the other sheet only in nonadhesive bearing areas that are recessed with respect to the layers of pressure-sensitive adhesive, the pressure-sensitive adhesive along at least some of said pattern of pressure sensitive adhesive requiring a separation force from the rear major surface of the other sheet of over 5 grams per inch;

printing indicia on the front surfaces of both of the sheets in the sheet assembly using a printer that can print sheet on opposite surfaces;

separating the sheets along predetermined planes normal to and extending across the major surfaces of the sheets to form the custom printed notes.

2. A method for making custom printed note pads, said method comprising the steps:

providing a plurality of sheet assemblies each comprising first and second sheets each having major front and rear surfaces and opposite edges, and layers of pressure-sensitive adhesive in a predetermined pattern on the rear surface of each of said sheets, said layers of pressure-sensitive adhesive on the rear surface of each of said sheets in each of said sheet assemblies contacting and being releasably adhered to the rear surface of the other sheet only in nonadhesive bearing areas that are recessed with respect to the layers of pressure-sensitive adhesive, and being releasably adherable to the front surfaces of the sheets, the pressure-sensitive adhesive along at least some of said pattern of pressure sensitive adhesive requiring a separation force from the rear major surface of the other sheet of over 5 grams per inch;

printing indicia on the front surfaces of both of the sheets in at least some of the sheet assemblies using a printer that can print a sheet on opposite surfaces;

separating the sheets in the sheet assemblies after said printing step; and stacking the separated sheets to adhere the layers of pressure-sensitive adhesive on the rear surfaces of the sheets to the front surfaces of the sheets with the layers of adhesive in a predetermined orientation with respect to each other.

3. A method for making custom printed note pads according to claim 2 wherein said method further includes the step of separating the stacked sheets along predetermined planes normal to and extending across the major surfaces of the stacked sheets to form the custom printed note pads.

4. A method for making custom printed note pads according to claim 2 wherein said providing step provides the layers of pressure-sensitive adhesive on the rear surfaces of each of said sheets in strips aligned with predetermined ones of the planes along which the stacked sheets are separated in the separating step such that each of the sheet portions in each of the custom printed note pads has a portion of one of the strips of adhesive along a corresponding edge of the pad.

5. A method for making custom printed note pads according to claim 2 wherein said providing step provides the layers of pressure-sensitive adhesive on the rear surfaces of said sheets in strips aligned with the predetermined ones of the planes along which the stacked sheets are separated in the separating step such that each successive sheet portion in each of the custom printed note pads has a portion of one of the strips of adhesive along an opposite edge of the pad.

6. A sheet assembly adapted to be printed on one or both sides and subsequently converted into a plurality of sheets each having printing on one surface and a small area of pressure-sensitive adhesive on an opposite surface, said sheet assembly comprising first and second sheets each having major front and rear surfaces and opposite edges, and layers of pressure-sensitive adhesive in a predetermined pattern on the rear surface of each of said sheets, said pattern of pressure-sensitive adhesive on the rear major surface of each of said sheets contacting and being releasably adhered to the rear major surface of the other sheet only in nonadhesive areas that are recessed with respect to the pattern of pressure-sensitive adhesive, the pressure-sensitive adhesive along at least some of said pattern of pressure sensitive adhesive requiring a separation force from the rear major surface of the other sheet of over 5 grams per inch.

7. A sheet assembly according to claim 6 wherein said adhesive is a low-tack pressure-sensitive adhesive and said nonadhesive bearing areas are free of release coating.

8. A sheet assembly according to claim 7 wherein said low-tack pressure-sensitive adhesive comprises tacky, elastomeric copolymer microspheres.

9. A sheet assembly according to claim 6 further including a release coating on said nonadhesive bearing areas.

10. A sheet assembly according to claim 6 further including a release material on the front surface of one or both of said sheets.

11. A sheet assembly according to claim 10 wherein said release material comprises an indicia-receptive polymer.

12. A sheet assembly according to claim 6 wherein said sheet assembly further includes means along one of said edges for indicating the orientation of the layers of pressure-sensitive adhesive in the sheet assembly.

13. A sheet assembly according to claim 12 wherein a portion of said first sheet adjacent one edge of said first sheet extends past the adjacent edge of said second sheet to provide said means along one of said edges for indicating the orientation of the layers of pressure-sensitive adhesive in the sheet assembly.

14. A sheet assembly according to claim 6 wherein said sheets are attached along adjacent edges and have a path of weakness along said joined edges so that the sheets are sufficiently joined together along said edges to facilitate printing of the front surfaces of the sheets without separation of the sheets.

15. A sheet assembly according to claim 6 having a release coating on all of the nonadhesive bearing areas of one of said sheets and having a release coating on only a portion of the nonadhesive bearing areas of the other of said sheets so that the adhesion between at least one layer of adhesive and one nonadhesive bearing area that has no release coating will adhere the sheets together with sufficient firmness to facilitate printing of the front surfaces of the sheets without separation of the sheets.

16. A sheet assembly according to claim 6 wherein said sheets are of material selected from the group consisting of plane paper, bond paper, clay-coated paper, opaque polymeric material, translucent polymeric material and carbonless paper.

17. A sheet assembly according to claim 6 wherein the total area covered by the layers of pressure-sensitive adhesive on both of said sheets is less than 50 percent of the total surface areas of the rear surfaces of both of said sheets.

* * * * *